US005593607A

United States Patent [19]

Dam et al.

[11] Patent Number: 5,593,607

[45] Date of Patent: Jan. 14, 1997

[54] COMBUSTION CATALYST WIRE WRAPPED ON CORROSION RESISTIVE GLOW PLUGS

[75] Inventors: Chuong Q. Dam; Kent A. Koshkarian; Martin L. Willi, all of Peoria, Ill.

[73] Assignee: Caterpillar Inc., Peoria, Ill.

[21] Appl. No.: 493,065

[22] Filed: Jun. 21, 1995

[51] Int. Cl.[6] ..... F23Q 7/00

[52] U.S. Cl. ..... 219/270; 123/145 A

[58] Field of Search ..... 219/270, 267, 219/260; 123/145 A, 145 R; 361/264–266

[56] References Cited

U.S. PATENT DOCUMENTS

| | | | |
|---|---|---|---|
| 4,343,986 | 8/1982 | Mitani et al. | 219/543 |
| 4,852,530 | 8/1989 | John | 123/145 A |
| 4,896,636 | 1/1990 | Pfefferle | 123/145 A |
| 5,146,881 | 9/1992 | Pfefferle | 123/145 A |

FOREIGN PATENT DOCUMENTS

| | | |
|---|---|---|
| 55-143326 | 11/1980 | Japan . |
| 57-204729 | 12/1982 | Japan . |
| 58-217778 | 12/1983 | Japan . |
| 59-66618 | 4/1984 | Japan . |
| 59-167635 | 9/1984 | Japan . |

*Primary Examiner*—John A. Jeffery
*Attorney, Agent, or Firm*—Pankaj M. Khosla; Frank L. Hart

[57] ABSTRACT

A glow plug has a heating element and a ceramic silicon nitride tip which has an outer surface. A low porosity refractory metal oxide coating covers at least a portion of the tip outer surface. A catalyst wire, with a diameter of 0.008 inches, is wrapped about and connected to the coated glow plug tip. The wire is formed of one of the platinum group metals and the wire is free of charge carrying connection to a power source.

10 Claims, 2 Drawing Sheets

COMBUSTION CATALYST WIRE WRAPPED ON CORROSION RESISTIVE GLOW PLUGS

TECHNICAL FIELD

The present invention relates to glow plugs for an internal combustion engine.

1. Background Art

Glow plugs are well known in the art and are of various construction with a multiplicity of different materials. Examples of such glow plugs are found in U.S. Pat. No. 4,896,636, filed Feb. 17, 1989, and issued to W. C. Pfefferle on Jan. 30, 1990 and U.S. Pat. No. 5,146,881, filed Feb. 15, 1990, and issued as a continuation in part to W. C. Pfefferle.

One of the problems with glow plugs of internal combustion engines is forming a glow plug in a construction and with materials that will have relatively long life in their operational environment. This operational environment also generates additional problems when alternate fuels such as methanol, ethanol, propane, natural gas, and water emulsion are used alone or in combination with diesel fuel to operate the engine.

The present invention is directed to overcome one or more of the problems as set forth above.

2. Disclosure of the Invention

A glow plug has a heating element having a tip, said tip having an outer surface. A low porosity refractory material covers at least a portion of the tip outer surface. A catalyst is wrapped about and in intimate contact with the glow plug tip coating. The catalyst is formed of one of the platinum group metals, a transition metal and a combination thereof. The catalyst is free of charge carrying connection to a power source.

BEST MODE FOR CARRYING OUT THE INVENTION

Figure 1:
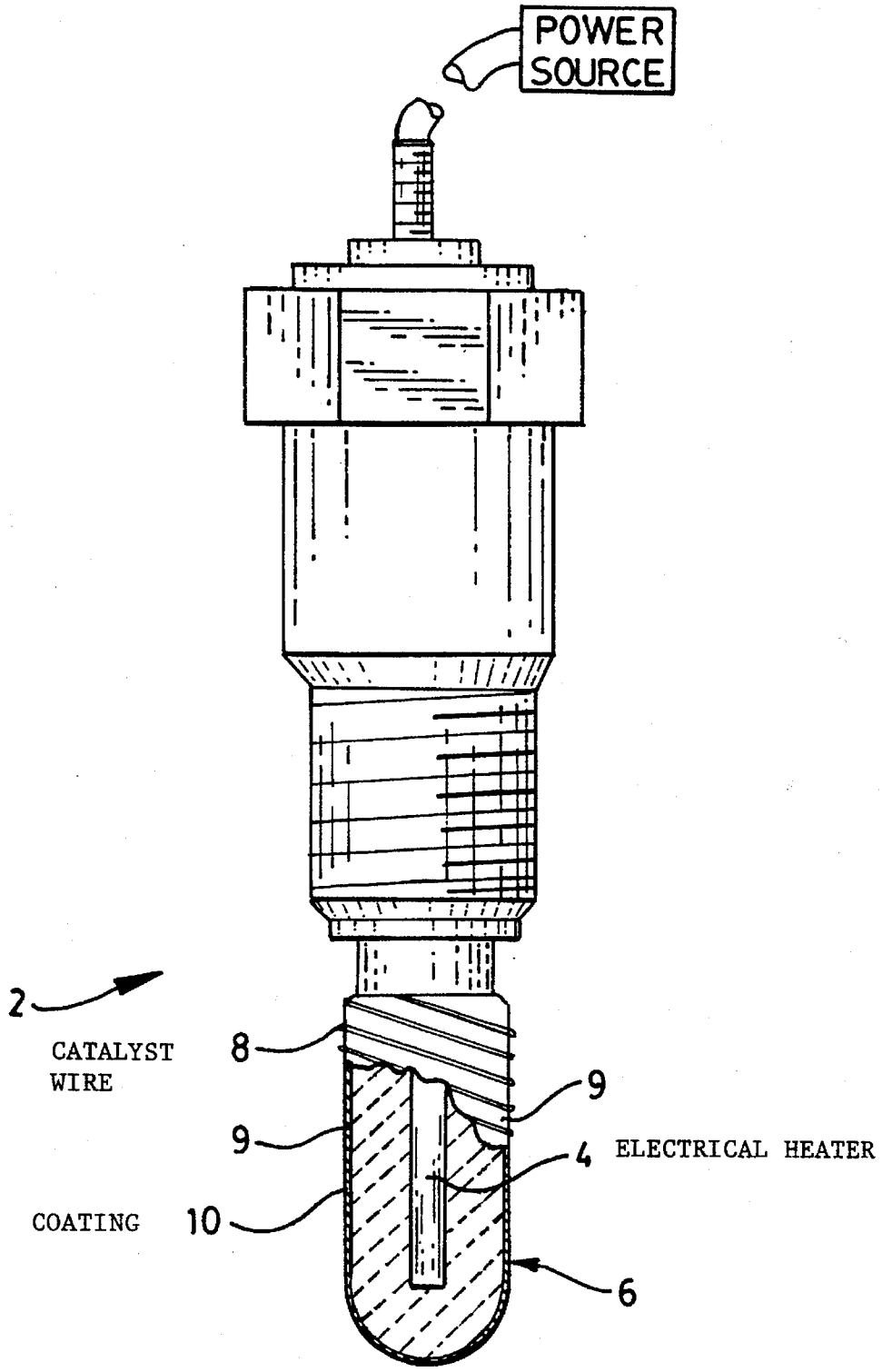
FIG. 1 is a diagrammatic view is partial section of a glow plug of this invention.
Figure 2:
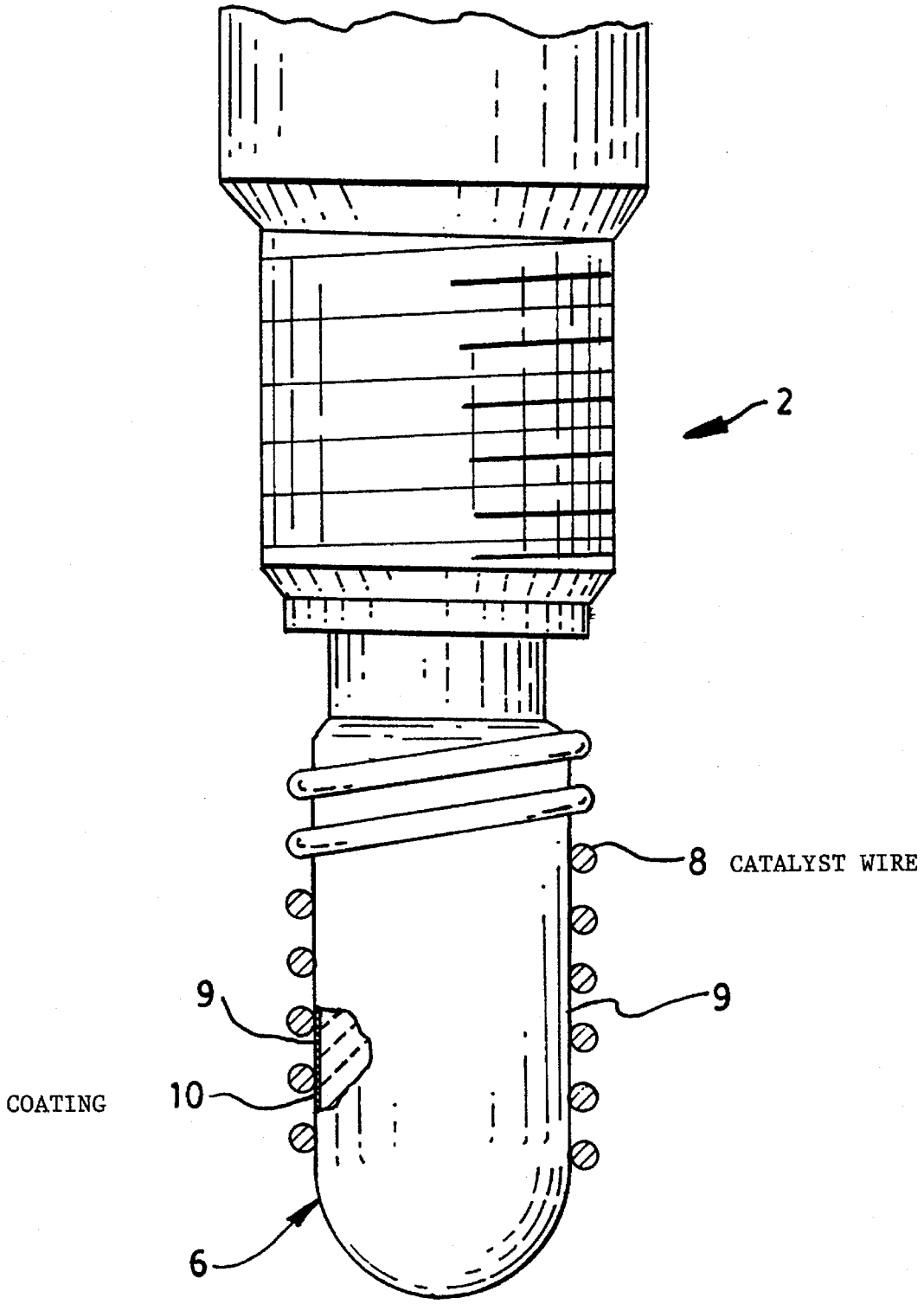
FIG. 2 is an enlarged view of a portion of the glow plug tip.

Referring to FIGS. 1 and 2, a glow plug 2, as is well known in the art, has a heating element 4 and a ceramic silicon nitride tip 6 having an outer surface 9. These well known glow plugs 2 have controls (not shown) for heating the heating element 4, which heat passes outwardly to and through the glow plug tip 6 and into contact with fuel passing into the combustion chamber. During engine operation, the controlling element monitors the temperature of a portion of the glow plug 2 and maintains the temperature within a preselected temperature range.

In the glow plug 2 of this invention, a low porosity refractor metal oxide coating 10 covers at least a portion, preferably all, of the silicon nitride tip outer surface 9. The coating 10 can be one of tantalum oxide, aluminum oxide, and mullite, for example. Preferably, the coating 10 is tantalum oxide and preferably has a thickness in the range of about 0.003 inches to about 0.015 inches. Thickness less than about 0.0005 inches are undesirable because the coating may not be sufficiently dense to seal the silicon nitride tip from the combustion environment and thickness greater than about 0.030 inches are undesirable because such coatings would have high thermal stresses and act as a thermal barrier to the heat flowing from the heating element and thereby represent a waste of time, labor, equipment, and natural resources since further thickness of the coating 10 provides no beneficial advantage.

The coating 10 can be applied to the glow plug tip 6 by various means known in the art. Preferably the coating 10 is applied by the techniques of thermal spray.

A catalyst wire 8 is wrapped about and in intimate contact with the coated glow plug tip 6. The catalyst wire 8 is selected from one of the platinum group metals, a transition metal, and a combination thereof, preferably platinum. The catalyst wire is free of charge carrying connection to a power source.

As better seen in FIG. 2, the catalyst wire has a diameter greater than about 0.003 inches. Diameters smaller than about 0.003 inches are undesirable because the lack of sufficient mechanical strength, integrity and durability. Preferably, the catalyst wire has a diameter of about 0.008 inches. It is also preferred that the maximum amount of catalyst be concentrated at the region with the greatest glow plug temperature.

The tip 6 of the glow plug 2 has a longitudinal axis and the catalyst wire 8 is preferably helically wrapped about the longitudinal axis.

The catalyst wire 8 is preferably of round cross sectional configuration, although it should be understood that the cross sectional configuration may be of other alternate shapes. Portions of the catalyst material be in intimate contact with the corrosive resistive coating.

INDUSTRIAL APPLICABILITY

Active catalyst material may produce and maintain very high surface temperature which will enhance combustion. Coating 10 protects the glow plug from excessive heat exposure. By so construction the glow plug 2, hot spots developed on the tip 6 are dissipated by the heat traveling along the catalyst wire 8 thereby producing a more uniform heat per unit length of glow plug tip 6. High temperatures detrimentally affect the life of the glow plug 2. By so dissipating the heat via the catalyst wire 8, the conventionally used temperature controller functions with improved efficiency, ergo the glow plug is more efficient and longer lived. The catalyst wire also functions to provide a glow plug that will function efficiently at a lower temperature. Additional corrosion protection of the silicon nitride tip 6 is provided by the coating 10 and therefore the combination of the coating and the catalyst wire function together to provide an improved plug over heretofore utilized materials and constructions.

Helically wrapping of the catalyst wire avoids the waste of manufacturing time and labor and by providing a cross-sectionally round wire of relatively large surface area, large areas of catalyst are desirably exposed to the atmosphere of the combustion zone.

Other aspects, objects and advantages of this invention can be obtained from a study of the drawings, the disclosure and the appended claims.

We claim:

1. A glow plug having a heating element and having a tip, said tip having an outer surface, comprising:

a low porosity refractory metal oxide coating covering at least a portion of the tip outer surface; and a catalyst wrapped about and in intimate contact with the glow plug tip coating, said catalyst having a shape in the form of a wire, said wire having a cross-sectional area in the range of about $10\times10^{-6}$ $in^2$ to about $300\times10^{-6}$ $in^2$, and being formed of one of platinum group metals, transition metals or a combination thereof and said catalyst being free of charge carrying connection to a power source.

2. A glow plug, as set forth in claim 1, wherein the coating covers substantially all of the glow plug tip.

3. A glow plug, as set forth in claim 1, wherein the coating is one of tantalum oxide, aluminum oxide and mullite.

4. A glow plug, as set forth in claim 3, wherein the coating is tantalum oxide.

5. A glow plug, as set forth in claim 1, wherein the coating has a thickness in the range of about 0.003 inches to about 0.015 inches.

6. A glow plug, as set forth in claim 5, wherein the coating has a thickness of about 0.008 inches.

7. A glow plug, as set forth in claim 1, wherein said catalyst wire has a diameter of about 0.008 inches.

8. A glow plug, as set forth in claim 1, wherein said glow plug tip has a longitudinal axis and said catalyst wire is helically wrapped about the longitudinal axis.

9. A glow plug, as set forth in claim 1, wherein said catalyst wire is of round cross sectional configuration.

10. A glow plug, as set forth in claim 1, wherein the catalyst wire is formed of platinum.

* * * * *